US007621130B2

(12) United States Patent
Ceccherini et al.

(10) Patent No.: US 7,621,130 B2
(45) Date of Patent: Nov. 24, 2009

(54) COMBUSTION SYSTEM WITH LOW POLLUTING EMISSIONS

(75) Inventors: Gianni Ceccherini, Sesto Fiorentino (IT); Roberto Modi, San Pietro A. Sieve (IT); Vanni Nannicini, Prato (IT)

(73) Assignee: Nuovo Pignone Holding S.p.A., Florence (IT)

( * ) Notice: Subject to any disclaimer, the term of this patent is extended or adjusted under 35 U.S.C. 154(b) by 374 days.

(21) Appl. No.: 10/596,926

(22) PCT Filed: Dec. 22, 2004

(86) PCT No.: PCT/EP2004/014773

§ 371 (c)(1),
(2), (4) Date: Jun. 29, 2006

(87) PCT Pub. No.: WO2005/064239

PCT Pub. Date: Jul. 14, 2005

(65) Prior Publication Data

US 2007/0169483 A1 Jul. 26, 2007

(30) Foreign Application Priority Data

Dec. 30, 2003 (IT) ..... MI2003A2621

(51) Int. Cl.
*F02C 1/00* (2006.01)

(52) U.S. Cl. ..... 60/737; 60/746

(58) Field of Classification Search ..... 60/737, 60/738, 740, 746, 747
See application file for complete search history.

(56) References Cited

U.S. PATENT DOCUMENTS

| | | | | |
|---|---|---|---|---|
| 5,381,652 | A * | 1/1995 | Mezzedimi et al. | 60/39.23 |
| 5,660,044 | A * | 8/1997 | Bonciani et al. | 60/737 |
| 5,862,668 | A * | 1/1999 | Richardson | 60/737 |
| 5,885,068 | A | 3/1999 | Dobbeling et al. | |
| 6,058,710 | A * | 5/2000 | Brehm | 60/747 |
| 6,094,904 | A * | 8/2000 | Goodrich et al. | 60/803 |
| 6,880,339 | B2 * | 4/2005 | Modi et al. | 60/737 |
| 6,966,187 | B2 * | 11/2005 | Modi et al. | 60/752 |
| 7,143,583 | B2 * | 12/2006 | Hayashi et al. | 60/776 |
| 2002/0078684 | A1 * | 6/2002 | Carberry et al. | 60/295 |
| 2004/0154301 | A1 * | 8/2004 | Freeman et al. | 60/737 |
| 2005/0016177 | A1 * | 1/2005 | Modi et al. | 60/737 |

FOREIGN PATENT DOCUMENTS

| | | |
|---|---|---|
| EP | 0589520 A | 3/1994 |
| EP | 0670456 A | 9/1995 |
| EP | 0800041 A | 10/1997 |
| EP | 1087178 A | 3/2001 |
| EP | 1321714 A | 6/2003 |

* cited by examiner

*Primary Examiner*—Michael Cuff
*Assistant Examiner*—Phutthiwat Wongwian
(74) *Attorney, Agent, or Firm*—Potomac Patent Group PLLC

(57) ABSTRACT

Combustion system (10) for a gas turbine equipped with a premixing chamber (12) for air which is mixed with the fuel injected from a series of holes (11) creating a main central flame which is formed in a flame tube (14), the premixing chamber (12) is convergent towards a connection end with a combustion chamber comprising the flame tube (14), the combustion system (10) comprises a series of pilot devices (20) with premixing of the fuel gas, which create a series of corresponding pilot flames suitable for stabilizing the main central flame itself, at the same time reducing the polluting emissions.

16 Claims, 3 Drawing Sheets

COMBUSTION SYSTEM WITH LOW POLLUTING EMISSIONS

TECHNICAL FIELD

The present invention relates to a combustion system with low polluting emissions, in particular a combustion system for a gas turbine.

BACKGROUND

It is known that gas turbines are machines consisting of a compressor and a turbine with one or more phases, which are connected to each other by at least one combustion chamber.

Air from the outside environment is fed to the compressor to bring it under pressure.

The pressurized air passes through a premixing chamber, terminating with a nozzle or convergent portion. In said chamber, at least one injector feeds fuel which is mixed with the air to form an air-fuel mixture to be burnt.

The fuel necessary for producing combustion is therefore introduced into the combustion chamber by means of a pressurized network. The purpose of said combustion is to cause an increase in the temperature and enthalpy of the gas.

In order to improve the flame stability characteristics, a parallel fuel feeding system, suitable for generating a pilot flame, is also generally envisaged.

U.S. Pat. No. 5,381,652 indicates a combustion system for gaseous fuels in which a main flame is stabilized by means of a pilot device.

In this case, the pilot device injects pilot fuel gas into the combustion chamber, with which the combustion system is equipped.

A duct is present in the combustion system, for premixed air which flows to a first central duct in which there is a first series of radial holes for the fuel gas which feeds the main flame.

In the main duct, the air is premixed with the gaseous fuel fed by injection through a second series of holes, which are situated on cylinders positioned on a section of the main air duct, at the same distance along the perimeter of the section itself.

In this case, the injection of the pilot fuel is effected by means of a first series of radial holes situated at the outlet of the premixing duct, surrounding the main flame.

As this pilot fuel has not been previously mixed with comburent air, it burns in flames mainly controlled by the diffusion process of the fuel in the comburent air, which are consequently called diffusion flames.

Diffusion flames are characterized by the presence of areas in which the temperature is extremely high, therefore causing high polluting emissions.

The emission of nitrogen oxides is, in fact, proportional to the maximum flame temperature and flames of the diffusion type having high temperatures are consequently most responsible for polluting emissions, in particular emission of nitrogen oxides.

One of the disadvantages of the present system is that it has moderate polluting emissions due to the presence of diffusion-type flames.

U.S. Pat. No. 5,666,044 describes the use of pilot devices for stabilizing the main flame, which inject fuel gas through nozzles into the combustion chamber.

Air, necessary for the combustion of the fuel gas injected by means of the pilot device is contemporaneously injected into the combustion chamber, in an area adjacent to each pilot device. Also in this case, the mixing takes place in the combustion chamber, and the flames are consequently of the diffusive type, even if the presence of the high quantity of air in the area adjacent to the injection, reduces the extension of high temperature areas.

A combustion system is also known from the patent application EP 1321715A2, which can be used with liquid or gaseous fuel, in which there are devices which inject the pilot fuel directly into the combustion chamber.

One of the disadvantages of this solution is that it generates significant emissions of polluting agents, also in this case due to the presence of flames of the diffusion type used for stabilizing the main premixed flame.

SUMMARY

An objective of the present invention is to provide a combustion system with low polluting emissions which allows a reduction in the polluting emissions of gas turbines.

Another objective is to provide a combustion system with low polluting emissions which allows reduced oscillations of the pressure inside the combustion chamber and at the same time allows the flame to be stabilized.

A further objective is to avail of a combustion system with low polluting emissions which allows a high duration of the components subject to high temperatures.

Yet another objective is to avail of a combustion system with low polluting emissions which allows a high combustion efficiency and at the same time has low polluting emissions.

These objectives according to the present invention are achieved by providing a combustion system with low polluting emissions as specified in claim 1.

Further characteristics of the invention are described in the subsequent claims.

BRIEF DESCRIPTION OF THE DRAWINGS

The characteristics and advantages of a combustion system with low polluting emissions according to the present invention will appear more evident from the following illustrative and non-limiting description, referring to the enclosed schematic drawings, in which.

DETAILED DESCRIPTION OF THE EMBODIMENTS

Figure 1:
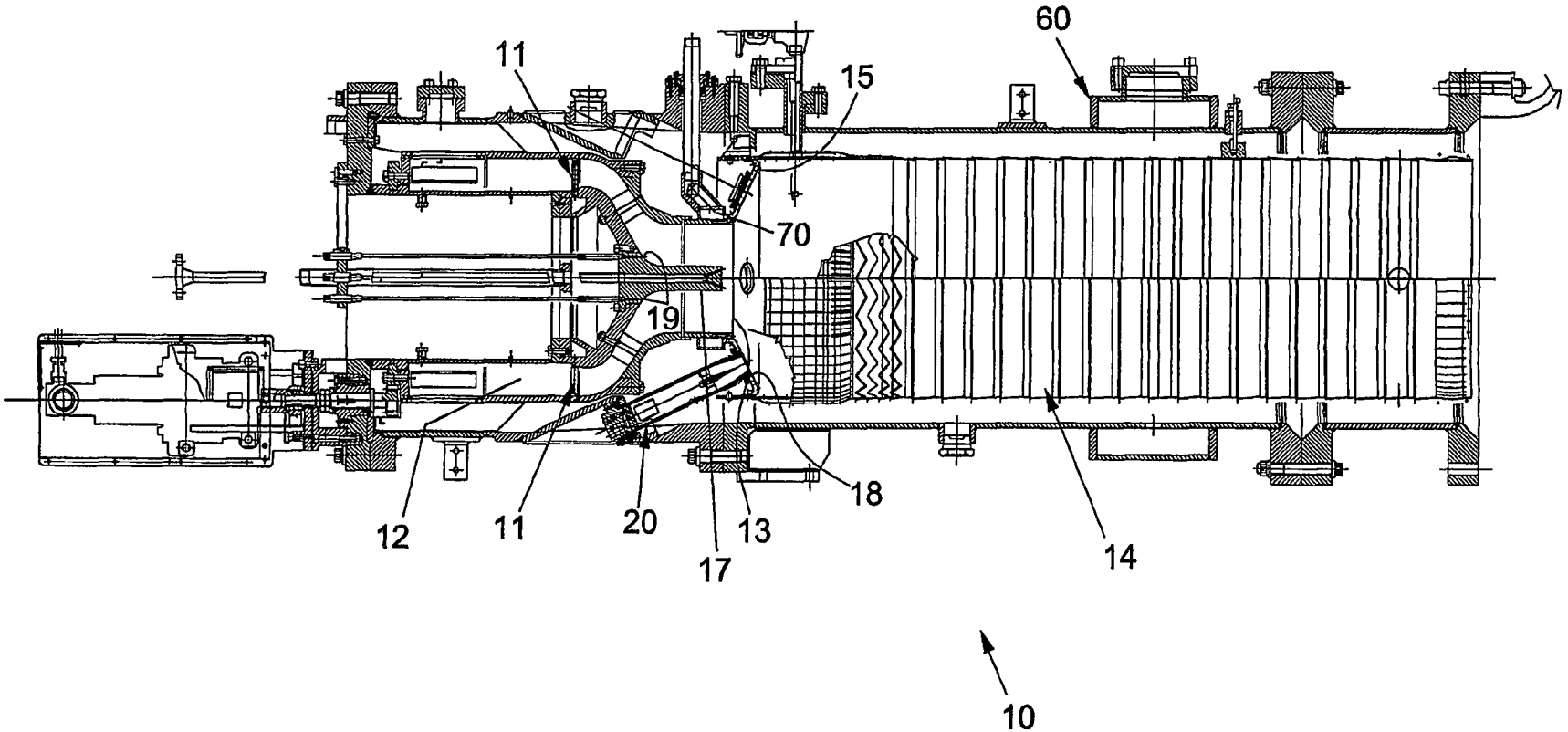
FIG. 1 is a partially sectional view from above of a first preferred embodiment of a combustion system according to the present invention.

With reference to the figures, these illustrate a combustion system with low polluting emissions, indicated as a whole with 10, which comprises a combustion chamber containing a "liner" or flame tube 14 suitable for containing a main flame.

The flame tube 14 has a tapered connection end 15 to a premixing chamber 12 of the air, in correspondence with a terminal section 13 of the premixing chamber 12.

The air premixing chamber 12 is substantially a duct in the form of a circular crown which has a tapered section, or narrower section, towards a connecting end to the combustion chamber, to accelerate the air after this has been premixed using fuel gas fed by a series of holes 11 preferably situated on cylindrical elements positioned in the perimeter of the premixing chamber 12.

Said series of holes 11 is situated along a section which precedes the tapered end of the air premixing chamber 12.

The tapered end of the air premixing chamber 12 has a circular section in which there is a central body 17 which extends into said tapered end for the injection of air suitable for preventing the flame from touching the surface of the central duct 17.

The combustion system 10 preferably comprises a series of thermocouples 19, outside the central duct 17.

The flame is normally formed in the combustion chamber downstream of the premixing chamber 12.

If, as a result of some abnormal functioning, the flame rises into the premixing chamber 12, the thermocouples 19 detect the increase in temperature and the flow of gas is interrupted to protect the premixing chamber 12 from excessive temperatures.

The tapered end 15 of the flame tube 14 has a surface in the form of a circular crown on which there are a series of pass-through holes 18 for housing a respective series of premixed fuel gas injection pilot devices 20 in order to stabilize the main central flame and at the same time maintain low levels of polluting emissions.

This is achieved by using a series of fuel gas premixing pilot devices 20, in which the fuel gas is mixed with a turbulent stream of air, obtaining a homogeneous mixture of fuel gas/air, before the injection of the mixture itself into the combustion chamber.

This allows a reduction in the polluting emissions of NOx as diffusion-type flames are avoided.

The combustion system 10 has a series of pilot devices 20 with premixing of the fuel gas which allow the main central flame to be stabilized, at the same time reducing the polluting emissions through a corresponding series of external flames.

Each pilot device of the series of pilot devices 20 comprises a premixing duct 29, a series of holes 28, inside the premixing duct 29, for the feeding of the fuel and a unit 24 acting as a swirler; said unit 24 has the function of creating a turbulent and whirling flow of air capable of uniformly mixing with the fuel gas fed through the series of holes 28 inside the device itself.

The turbulent flow of air is mixed with the fuel gas fed through the series of ducts 28, forming a homogeneous mixture of air and fuel gas inside the premixing duct 29, before the introduction of the combustion system 10 into the combustion chamber.

In this way, for each pilot device 20 a corresponding flame is obtained, having a maximum temperature lower than that of diffusion flames.

Consequently, as the maximum flame temperature is lower, the polluting emissions, among which NOx emissions, are correspondingly reduced.

The combustion system 10 comprises a series of pilot devices 20 each arranged in a respective hole of the series of ducts 18 which are distributed at an equal distance on a circumference lying on the surface of the end 15 of the flame tube 14 and coaxial with its axis.

The unit 24 of each pilot device 20 comprises at least one shaped element capable of increasing the turbulence of the flow of air in the premixing duct 29.

The air flow for each premixing pilot device 20 is preferably fed directly from the air flow coming from a compressor.

Furthermore, the flame of each pilot device 20 is stabilized.

The stabilization of the flame of premixed pilot burners 20 is effected by the injection of pilot fuel gas (therefore a sub-pilot) which stabilizes the premixed pilot flame which in turn stabilizes the main premixed flame.

The sub-pilot fuel gas produces diffusion flames but as only the premixed pilot fuel gas has to be stabilized, only a small quantity of fuel is used, thus producing lower polluting emissions of NOx.

Figure 4:
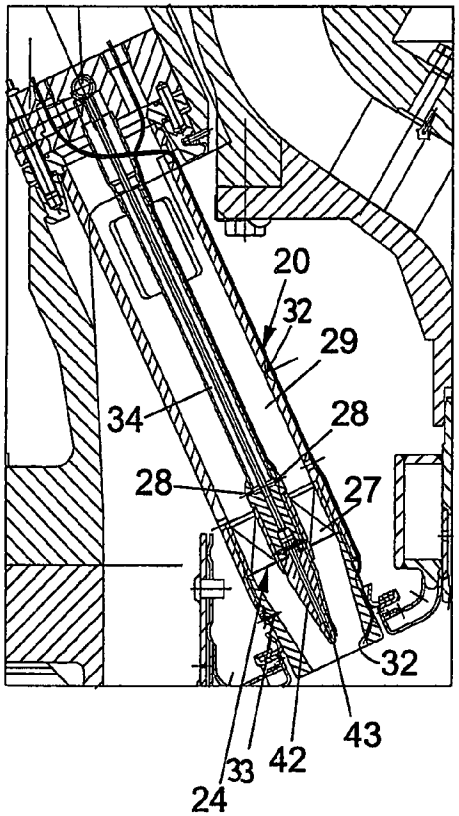
FIG. 4 is a first embodiment of a detail of FIG. 2 which shows a first embodiment of a premixed fuel injection pilot device.

According to an aspect of the present invention, a first preferred embodiment is provided, shown in FIG. 4, of a pilot device 20 equipped with a unit 24 in which said at least one shaped element comprises a series of shaped blades 27 suitably inclined to create a swirling motion of the air inside the premixing duct 29, ensuring that the turbulent air flow is uniformly mixed with the fuel gas fed through the series of ducts 28 inside the premixing duct 29 itself.

The pilot device 20 comprises a central element 42 inside the premixing duct 29 which internally comprises a central duct 43 in turn inside and coaxial to an annular duct 34.

The annular duct 34 has the function of feeding the fuel gas which, through the series of holes 28, is premixed with the air inside the premixing duct 29.

In this case, the flame relating to the pilot device 20 is centrally stabilized by the injection of combustible fluid through the duct 43.

Each pilot device of the series of fuel gas premixing pilot devices 20, also comprises two ducts 32 inside the premixing duct 29 to detect the flow-rate of the fluid inside the pilot device itself.

Figure 5:
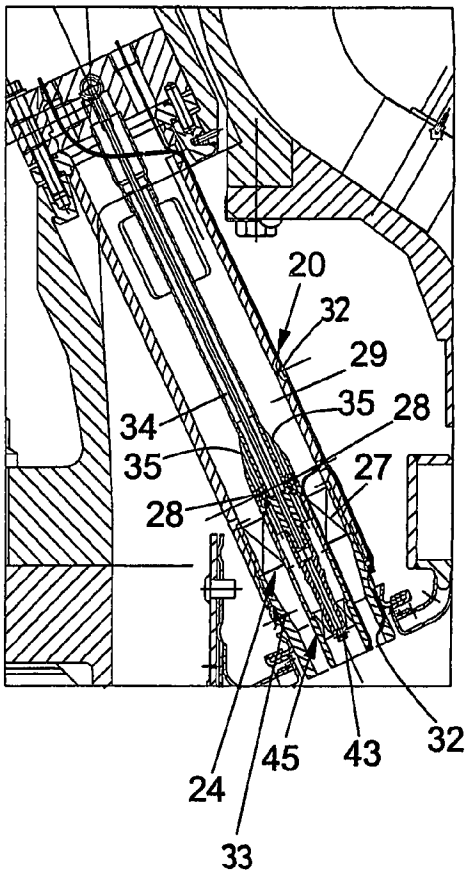
FIG. 5 is a second embodiment of a premixed fuel injection pilot device.

According to another aspect of the present invention, a second embodiment is provided, shown in FIG. 5, of a pilot device 20 equipped with a unit 24 in which said at least one shaped element, as in the first embodiment, also comprises a series of shaped blades 27 having the same function.

This embodiment is analogous to the first, except for the stabilization of the flame.

In this case, in fact, the flame relating to the pilot device 20 is centrally stabilized by the injection of combustible fluid by means of a central mini-burner 45 inside the premixing chamber 29.

Said mini-burner 45 is connected downstream of a central element inside the premixing duct 29, also present in the second embodiment, which internally comprises a central duct 43, in turn inside and coaxial to an annular duct 34.

The annular duct 34 has the function of feeding the fuel gas which, through the series of holes 28, is premixed with the air inside the premixing duct 29.

The duct 43 feeds the sub-pilot fuel gas for the mini-burner 45, whereas the air flow for the mini-burner 45 is fed by a series of holes 35 situated therein and is made turbulent by means of a further swirler present inside the mini-burner 45 itself.

Figure 3:
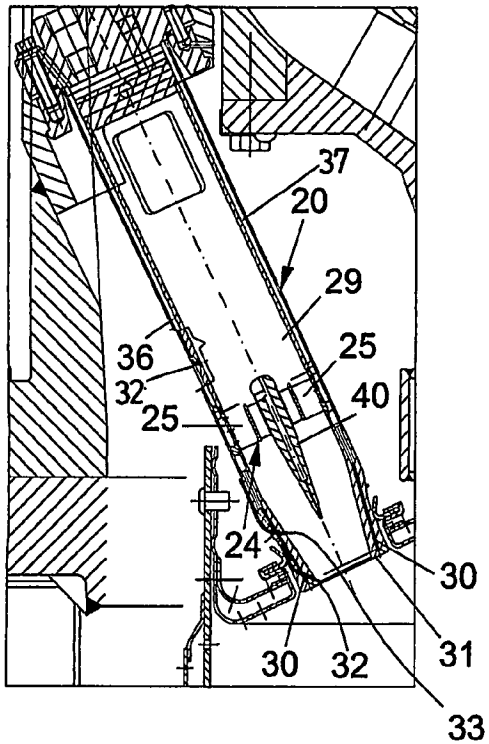
FIG. 3 is a third embodiment of a premixed fuel injection pilot device.

According to another aspect of the present invention, a third preferred embodiment of a pilot device 20 is provided, shown in FIG. 3, in which a unit 24 is present, in which said at least one shaped element comprises two series of shaped blades 25 to create a turbulent flow of air in the premixing duct 29.

Each premixing pilot device 20 comprises a duct 36 for the fuel gas connected to a series of holes 28 inside the premixing duct 29.

The fuel gas of the duct 36 is injected into the premixing duct 29, through the series of holes 28, for premixing with the turbulent air flow.

The flame of each pilot device 20 in this embodiment is also stabilized by the injection, into the combustion chamber, of fuel gas of a duct 37 fed through a series of holes 30 outside the premixing duct 29, situated on a base surface 31 of an end of the pilot device 20.

The duct 37 is therefore connected to the series of outer holes 30 to fed fuel gas in order to stabilize the flame of the pilot device 20 itself.

Each pilot device of the series of fuel gas premixing pilot devices 20, also comprises at least one thermocouple 33 and two ducts 32 inside the premixing duct 29 to detect the flow-rate of the fluid inside the pilot device 20.

It can be observed that a further fuel feeding duct 70, which surrounds the central duct 17, is also present in the combustion system 10.

Furthermore, said duct 70 is close to the tapered end 15 of the flame tube 14 where this is connected to the premixing chamber 12.

The duct 70 serves to feed the diffusion pilot fuel which surrounds the main flame, which can also be used for ignition or for stabilizing the flame under transitory conditions, when the emissions are not significant.

Figure 2:
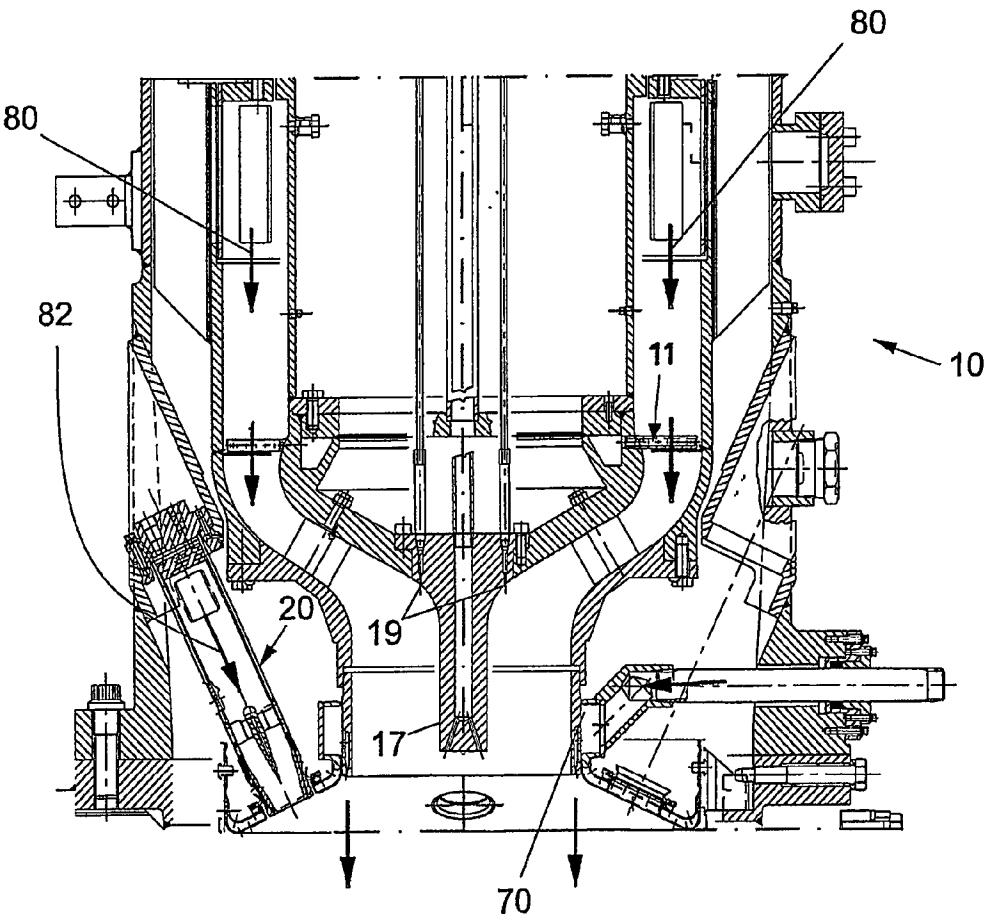
FIG. 2 is a detail of FIG. 1 which shows the air flows inside the combustion system.

With reference to FIG. 2, this also shows the air flows, indicated with 80 and 82, inside the combustion system 10, respectively regarding the premixed air flow of the premixing chamber 12 and the premixed air flow relating to one of the pilot devices 20 indicated in the figure.

The air coming from the compressor is mixed inside the premixing chamber 12 with the fuel fed from the series of holes 11.

The premixed air is subsequently accelerated and optionally mixed by diffusion with fuel gas fed from the duct 70.

The main flame is stabilized by means of a series of pilot flames functioning with premixed fuel gas.

Figure 6:
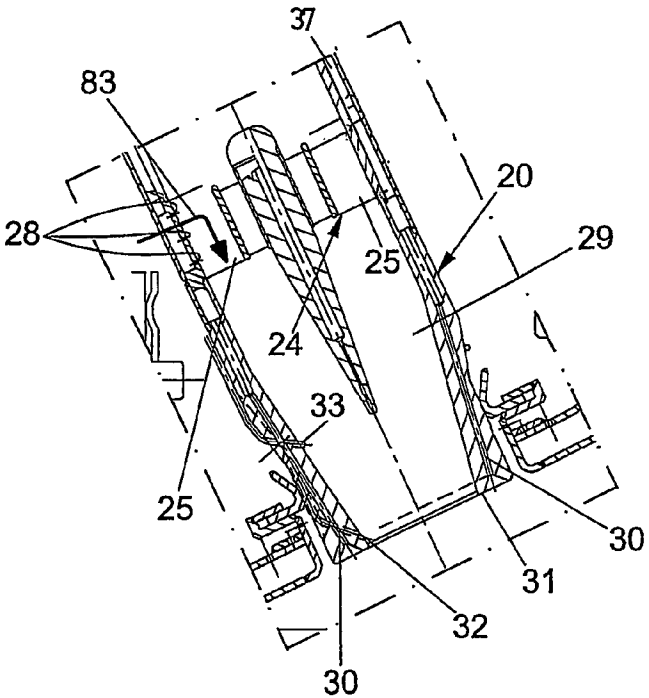
FIG. 6 is a detail of FIG. 3.

With reference to FIG. 6, it is possible to observe, in particular, the fuel flow, indicated with 83, fed from the holes of the series of holes 28, adjacent to the unit 24.

Furthermore, the pilot devices of the series of fuel gas premixing pilot devices 20 are preferably situated in the tapered end 15 of the flame tube 14, but a different arrangement can also be adopted.

The combustion system 10 comprises preferably a duct 60 for feeding air to the series of premixing pilot devices 20.

In conclusion, it can be summarized that a combustion system 10 for a gas turbine comprises a series of pilot devices 20 with premixing of the fuel gas, situated outside the main flame, or in a tapered connection end 15 to the premixing chamber 12, which create a series of corresponding pilot flames suitable for stabilizing the main central flame itself, at the same time reducing polluting emissions.

It can thus be seen that the combustion system with low polluting emissions according to the present invention achieves the objectives specified above.

Numerous modifications and variants can be applied to the combustion system with low polluting emissions of the present invention thus conceived, all included within the same inventive concept.

Furthermore, in practice, the materials used, as also the dimensions and components, can vary according to technical demands.

The invention claimed is:

1. A combustion system for a gas turbine comprising:

a premixing chamber for air which is mixed with fuel injected from a series of holes creating a main central flame which is formed in a flame tube, said premixing chamber is convergent towards a connection end with a combustion chamber comprising the flame tube;

the flame tube being connected to the premixing chamber through a tapered portion, the tapered portion having a series of holes positioned along a circumference of the tapered portion coaxial with a longitudinal axis of the flame tube;

a series of pilot devices distributed in the series of holes of the tapered portion and configured to premix fuel gas prior to injecting the fuel gas into the combustion chamber and create a series of corresponding pilot flames configured to stabilize the main central flame, at the same time reducing the polluting emissions; and each of the series of pilot devices includes a sub-pilot device configured to inject pilot fuel gas into the respective pilot device prior to mixing the pilot fuel gas and produce diffusion flames for stabilizing the pilot flame.

2. The combustion system with low polluting emissions according to claim 1, wherein each hole of the series of holes in the tapered portion houses a respective pilot device of the series of fuel gas premixing pilot devices.

3. The combustion system with low polluting emissions according to claim 1, wherein the holes of the series of holes in the tapered portion are positioned at an equal distance along the circumference of the tapered portion of the flame tube.

4. The combustion system with low polluting emissions according to claim 1, wherein the combustion system comprises a series of thermocouples outside the central body.

5. The combustion system with low polluting emissions according to claim 1, wherein the combustion system comprises a feeding duct of the fuel, which surrounds said central body.

6. The combustion system with low polluting emissions according to claim 1, wherein each pilot device of said series of pilot devices with premixing of the fuel gas comprises a premixing duct, a series of holes for the fuel gas inside the premixing duct and a unit comprising at least one shaped element so as to create turbulence in the air flow in order to obtain a homogenous mixture of air/fuel gas inside the premixing chamber itself.

7. The combustion system according to claim 6, wherein said at least one shaped element comprises a series of shaped blades.

8. The combustion system according to claim 6, wherein said at least one shaped element comprises two series of shaped blades.

9. The combustion system according to claim 7, wherein each pilot device of the series of fuel gas premixing pilot devices comprises a duct for the fuel gas, situated in a central element inside the premixing chamber for stabilizing the flame of the pilot device itself, said duct is inside and coaxial to an annular duct for the fuel gas in turn connected to the series of holes.

10. The combustion system according to claim 9, wherein each pilot device of the series of fuel gas premixing pilot devices comprises two ducts inside the premixing duct for detecting the flow-rate of the fluid inside the pilot device itself and at least one thermocouple.

11. The combustion system according to claim 7, wherein each pilot device of the series of fuel gas premixing pilot devices comprises a mini-burner inside the premixing duct for stabilizing the flame of the pilot device itself.

12. The combustion system according to claim 10, wherein the mini-burner comprises a series of holes for the air and characterized in that the mini-burner is connected to a duct for the fuel gas, inside and coaxial to an annular duct for the fuel gas, in turn connected to the series of holes.

13. The combustion system according to claim 8, wherein each pilot device of the series of fuel gas premixing pilot devices comprises a series of holes outside the premixing chamber for stabilizing the flame of the pilot device itself.

14. The combustion system according to claim 13, wherein each pilot device of the series of fuel gas premixing pilot devices comprises a duct connected to the series of external holes and a duct connected to the series of holes.

15. The combustion system according to claim 8, wherein each pilot device of the series of fuel gas premixing pilot devices comprises at least one thermocouple and two ducts inside the premixing duct.

16. The combustion system according to claim 11, wherein each pilot device of the series of fuel gas premixing pilot devices comprises at least one thermocouple and two ducts inside the premixing duct.

* * * * *

UNITED STATES PATENT AND TRADEMARK OFFICE

CERTIFICATE OF CORRECTION

PATENT NO. : 7,621,130 B2
APPLICATION NO. : 10/596926
DATED : November 24, 2009
INVENTOR(S) : Ceccherini et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 521 days.

Signed and Sealed this

Twenty-sixth Day of October, 2010

David J. Kappos

David J. Kappos
*Director of the United States Patent and Trademark Office*